US005495319A

United States Patent [19]

Storlie

[11] Patent Number: 5,495,319

[45] Date of Patent: Feb. 27, 1996

[54] DEVELOPING HOUSING HAVING A PLURALITY OF ANGLED RIBS

[75] Inventor: Chris A. Storlie, Spring Grove, Minn.

[73] Assignee: Hewlett-Packard Company, Palo Alto, Calif.

[21] Appl. No.: 254,343

[22] Filed: Jun. 6, 1994

[51] Int. Cl.[6] ..... G03G 15/09

[52] U.S. Cl. ..... 355/245; 118/657; 355/253

[58] Field of Search ..... 355/245, 253; 118/658, 653, 657

[56] References Cited

U.S. PATENT DOCUMENTS

| | | | |
|---|---|---|---|
| 4,235,193 | 11/1980 | Groen et al. | 118/658 |
| 4,602,863 | 7/1986 | Fritz et al. | 118/657 |
| 4,792,825 | 12/1988 | Saito et al. | 355/245 |
| 5,272,509 | 12/1993 | Pitts et al. | 355/284 |

FOREIGN PATENT DOCUMENTS 3-196071 8/1991 Japan .

*Primary Examiner*—Nestor R. Ramirez
*Attorney, Agent, or Firm*—Anthony J. Baca

[57] ABSTRACT

An arrangement for moving a developer material along the developer axis where a bulk of the developer material is stored in a reservoir located on one side of the developer. The developer consists of the reservoir and a housing having a cavity extending along the developer axis. Several angled ribs are formed inside the cavity. A magnetically transparent sleeve resides inside the cavity and is rotated about the axis. Finally a magnetic element placed inside the sleeve magnetically attracts the developer material toward the sleeve such that the rotation of the sleeve induces the rotation in the developer material. As the developer material comes into contact with the angled ribs, the rotation of the developer material is translated into a lateral motion along the axis by the angled ribs.

9 Claims, 5 Drawing Sheets

DEVELOPING HOUSING HAVING A PLURALITY OF ANGLED RIBS

FIELD OF THE INVENTION

This invention relates generally to electrophotographic printing also known as laser printing and more particularly to an arrangement that allows the toner supply to be located on one side of the developer.

BACKGROUND OF THE INVENTION

In conventional electrophotographic processes a latent charge image is formed on a recording surface and is then developed into a visible image by applying a pigmented developer material. A recording surface may consist, for example, of a photoconductive layer which is initially provided with a uniform electrostatic charge. The photoconductive layer is then selectively discharged in an image wise manner by exposing the recording layer to a light pattern corresponding to the image to be reproduced. This produces a latent electrostatic image to which charged developer particles will adhere. A developed image can be fixed or rendered permanent in various ways, such as applying heat, pressure, solvents and any combination of the above.

The foregoing is essentially an optical image reproduction process and is employed in most types of commercially available document photocopying machines and laser type printers. The photoconductive layer may be provided on the final recording medium or more often it may be provided on the surface of an intermediate transfer member such as rotary drum.

Various methods have been employed for developing the latent charge images created by the electrophotographic technique. One early developing method involved cascading the developer material across the latent image areas to be developed. Another method, referred to as powder cloud development, involved dispersing the developer particles in a moving stream or flow of air and then bringing the entraining particles into contact with the latent image bearing surface. Rotating fur brushes were also used to apply the developer particles to the recording surface in some early types of electrophotographic imaging apparatus.

A more common developing method at the present time is referred to as magnetic brush development. This involves the use of a magnetic element, typically in the form of a cylindrical roll, for carrying the developer material and applying it to the latent image bearing surface. The developer material may be of the two component type in which finely divided and pigmented toner powder is interspersed with somewhat large ferromagnetic carrier particles. Alternatively, the developer material may be of the single component type in which only one kind of particle is involved. A common type of single type component developer consists of fine particles of magnetic material, such as iron or iron oxide, encapsulated within a resin having a relatively low softening temperature. A suitable pigment such as carbon black is usually added to the resin in order to impart the desired color to the developer material.

When placed in a magnetic field a developer material of either the two component or single component type will form streamers resembling the bristles of a brush, similar to the way in which iron filings will align themselves with the magnetic flux lines at the ends of a bar magnet. This property is exploited in magnetic brush developing systems by utilizing a magnetic roll assembly to retain a brush like layer of developer material on its peripheral surface. The layer of developer is brought into the proximity of the latent image bearing surface which is usually moving in a direction normal to the roll axis as the roll itself rotates. The brushing action brings a developer material into intimate contact with the recording surface and permits electrostatic transfer to the developer particles from the roll to the latent image areas.

A number of different structural configurations have been employed in magnetic brush developing systems. The simplest arrangement is an exposed magnetic roll which carries a layer of developer material on its peripheral surface. The roll may be magnetized in various ways even intrinsically or by covering the peripheral surface of the roll with magnetic material. An alternative arrangement more widely used at the present time is a two part roll assembly consisting of an inner magnet magnetic element enclosed within an outer non-magnetic shell or sleeve. The shell is usually cylindrical in shape and provides a smooth carrier surface over which the developer particles can slide while being held by the inner magnetic element. The magnetic flux density at the shell surface is a function of the spacing between the shell and the inner magnetic element and of the magnetic permeability of the shell material. Therefore by appropriate selection of these factors it is possible to obtain close control over the magnetic field strength that is used to hold the developer particles on the surface of the shell. Another advantage of the shell is that it provides a useful barrier against contamination of the inner magnetic element and associated bearing, shafts, and the like with developer particles.

Various types of two part magnetic brush rolls have been proposed. In one form of the device the inner magnetic element rotates while the outer shell is held stationary. The rotation of the inner magnetic element causes a backward tumbling or somersaulting motion of the developer particles on the outside circumference of the shell resulting in a net propagation of the developer material in the direction opposite to the rotational direction of the magnetic element. The propagation rate of the developer particles is much less than the rotational speed of the magnetic element but is sufficient to assure continuous flow of developer particles into the developing zone. In another form of the device, the outer shell itself rotates with respect to the inner magnetic element which is held stationary. This embodiment is usually used with two component developers since the rotation of the outer shell induces thorough mixing between the toner and carrier particles and continues replacement of spent developer at the developing zone.

In embodiments where a rotatable shell is employed it is possible to control the rate of movement of the developer material by varying the rotational speed of the shell hence it is possible to deliver more developer material to the developing zone by increasing the rotational speed of the shell and conversely less developer material is carried to the developing zone when the shell speed is reduced. In the fixed shell embodiments a similar but less pronounced effect can be obtained by varying the speed of the inner magnetic element.

Although the foregoing discussion has been concerned primarily with the development of latent electrostatic images formed by the electrophotographic process, it should be pointed out that similar considerations apply to both magnetic imaging systems and electrostatic printing techniques as well. With electrostatic printing techniques a latent charge image is created non-optically on a diaelectrically charged retentive surface by means of an electrostatic printhead which is typically of a dot matrix type. The dialectic layer, like the photoconductive layer in electrophotographic apparatus, may be provided either on the final recording media or on an intermediate transfer member. Magnetic imaging can be carried out by magnetizing the selected areas of a layer of magnetic material using a magnetic recording head. Alternatively, magnetic imaging can also be accomplished by imparting uniform magnetization to a layer of magnetic material and then selectively demagnetizing the material in an image wise pattern by raising the temperature of the selected areas above the Curie Point of the material. Either method leaves a layer of material with a latent magnetic image which can be rendered visible by the application of a magnetically attractable developer material.

With rotatable shell embodiments it is important that a sufficient supply of developer material reside behind a rotatable shell. Typically this is accomplished by providing a large developer well behind the shell. While this design is simple, because the developed material is located equally along the length of the developer, it does require a considerable amount of space. Additionally, if the toner is refillable, it may be difficult to add toner evenly along the developer.

Present trends for electrophotographic printers are forcing a significant reduction in size. The aftermentioned large reservoir behind the developer consumes a considerable amount of space which could be put to better use, One size reduction approach relocates the reservoir to one side of the developer.

To allow the developer material to be stored at one end of the developer some apparatus use an auger to deliver the developer material down the length of the developer. The auger is an extended auger with a rotating helical element that drives the toner in a similar manner to a grain auger. Adding an auger to an existing developer requires additional parts and costs along with decreased mean time between failure. Therefore it is desirable to integrate the developer function such that an additional auger for delivery of the developer material is not necessary.

SUMMARY OF THE INVENTION

In order to accomplish the present invention, there is provided an arrangement for moving a developer material along the developer axis where a bulk of the developer material is stored in a reservoir located on one side of the developer. The developer consists of the reservoir and a housing having a cavity extending along the developer axis. Several angled ribs are formed inside the cavity.

A magnetically transparent sleeve resides inside the cavity and is rotated about the axis. Finally a magnetic element placed inside the sleeve magnetically attracts the developer material toward the sleeve such that the rotation of the sleeve induces the rotation in the developer material. As the developer material comes into contact with the angled ribs, the rotation of the developer material is translated into a lateral motion along the axis by the angled ribs.

DETAILED DESCRIPTION OF THE PREFERRED EMBODIMENTS

Figure 1:
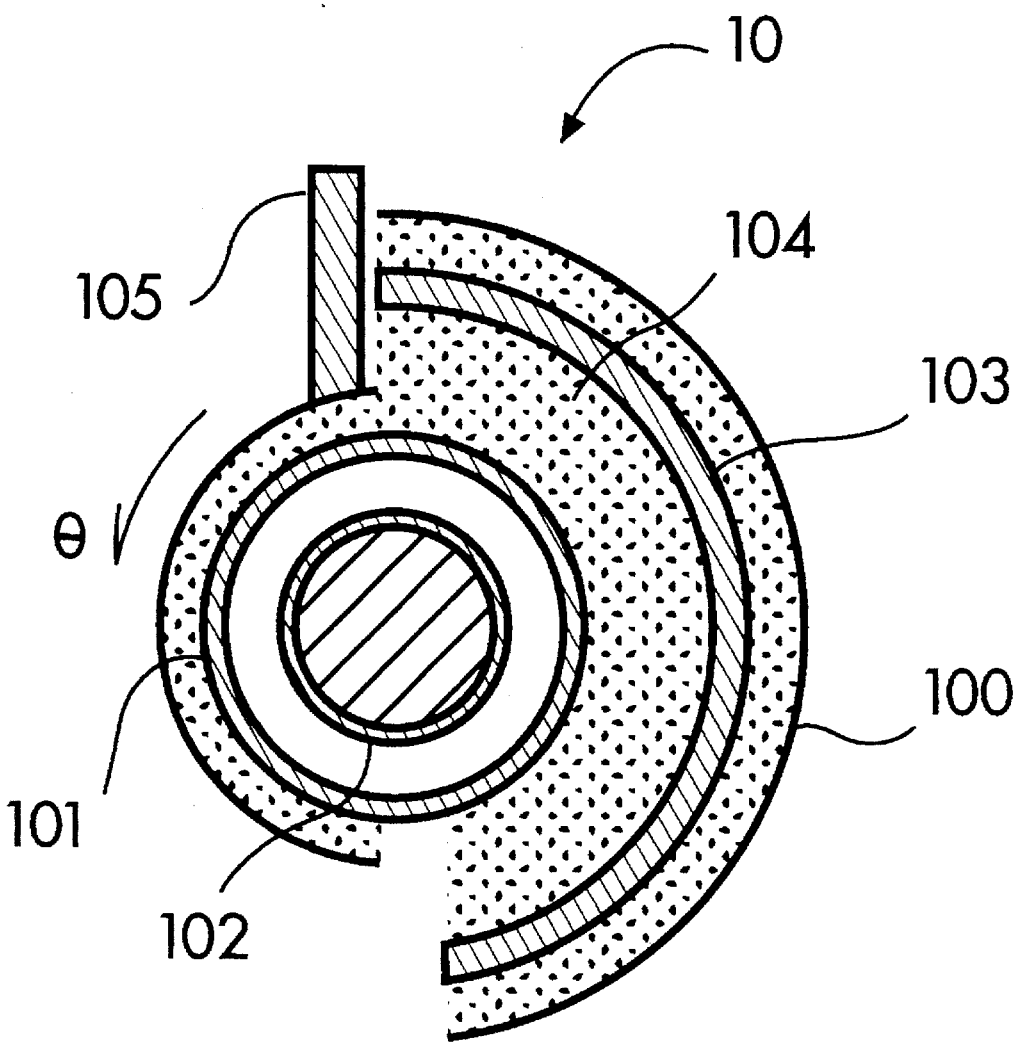
FIG. 1 is a side view of a developer that incorporates an embodiment of the present invention.

The present invention uses the rotation of developer sleeve to move the developer material down the length of the developer sleeve itself. Referring to FIG. 1 where a preferred embodiment of the present invention is shown. In the present embodiment the developer 10 consists of a magnetic element 102 down the center of a developer sleeve 101 where the developer sleeve 101 is of a non-magnetic material such as aluminum. The magnetic element 102 is stationary and its purpose is to attract developer material 104 (herein referred to as toner) to the developer sleeve 101. Developer sleeve 101 rotates around magnetic element 102 pulling the toner 104 around due to the friction of toner 104 on developer sleeve 101. As the toner 104 moves counter clockwise with developer sleeve 101 its height is decreased to a working level by doctor blade 105 as shown.

After toner 104 progresses past doctor blade 105 the magnetic field induced by magnetic element 102 causes toner 104 to form the previous described magnetic brushes. The magnetic brushes are brought into close proximity or light brushing contact with the latent image bearing surface not shown in FIG. 1. This latent image bearing surface will have an orientation identical to that of the developer sleeve with a directional movement normal to the developer sleeve 101. This brushing action brings toner 104 into direct contact with the recording surface and permits the electrostatic transfer of the toner 104 from developer sleeve 101 to the latent image areas.

Figure 2:
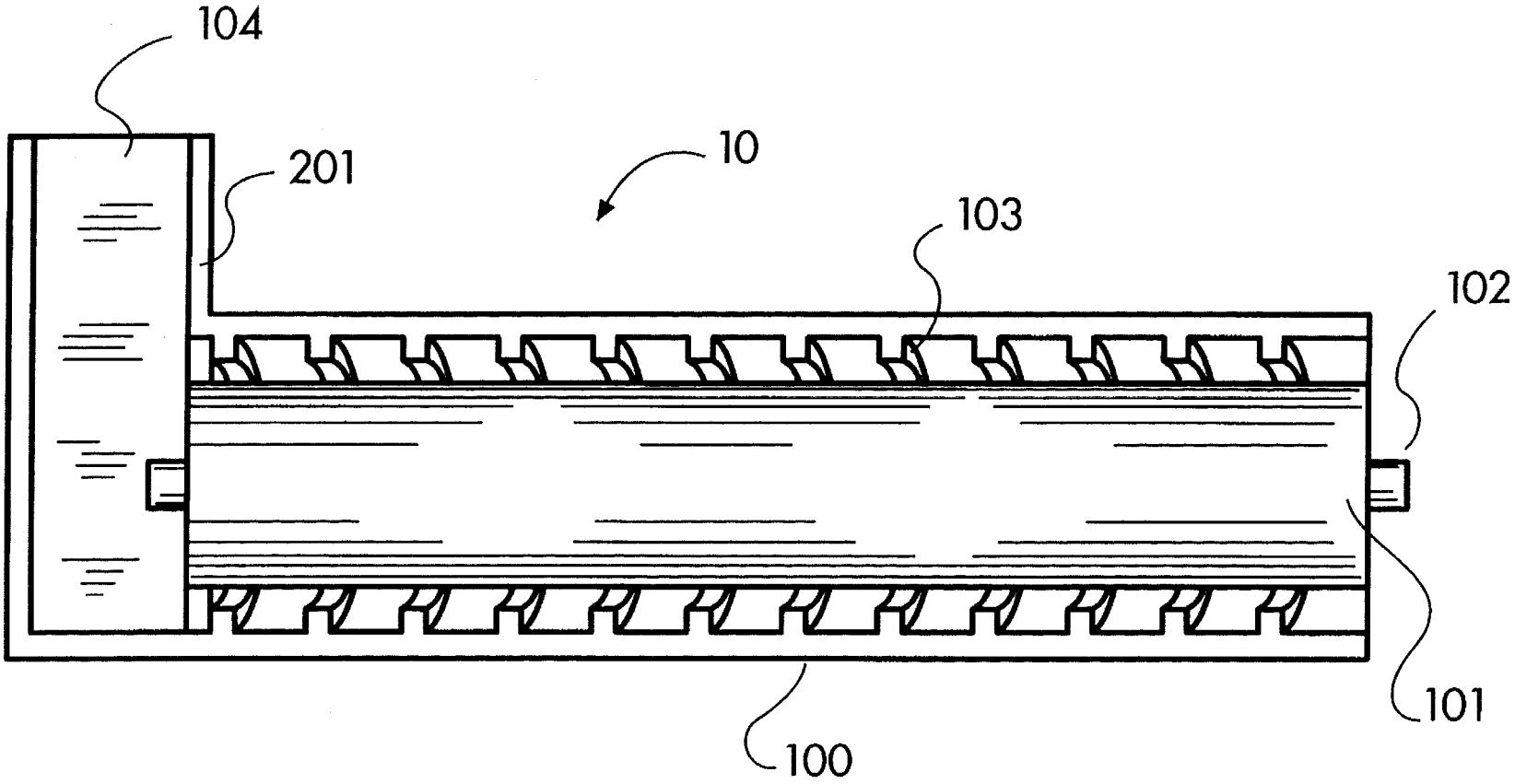
FIG. 2 shows a front view of the developer of FIG. 1.

Referring next to FIG. 2 where the developer 10 of FIG. 1 is shown from a longitudinal view, this figure shows that toner hopper 201 is located on one side of the developer 10. Thus some form of develope, material movement is necessary to ensure that the developer's far end has sufficient quantities of toner 104.

By forming ribs 103 on the backside of the developer housing 100. The developer sleeve's 101 motion imparts into the toner 104 a small longitudinal force thereby transporting the toner 104 down the developer housing 100.

More specifically, the normal force exerted by developer sleeve 101 on toner 104 induces a similar motion in toner 104. As toner 104 moves in a direction normal to the motion of developer sleeve 101 it is forced into ribs 103. The normal force of toner 104, as it comes in contact with ribs 103, creates a perpendicular force which propels toner 104 longitudinally along developer sleeve 101. As a side benefit to this longitudinal movement toner 104 also undergoes an increased mixing.

Figure 4:
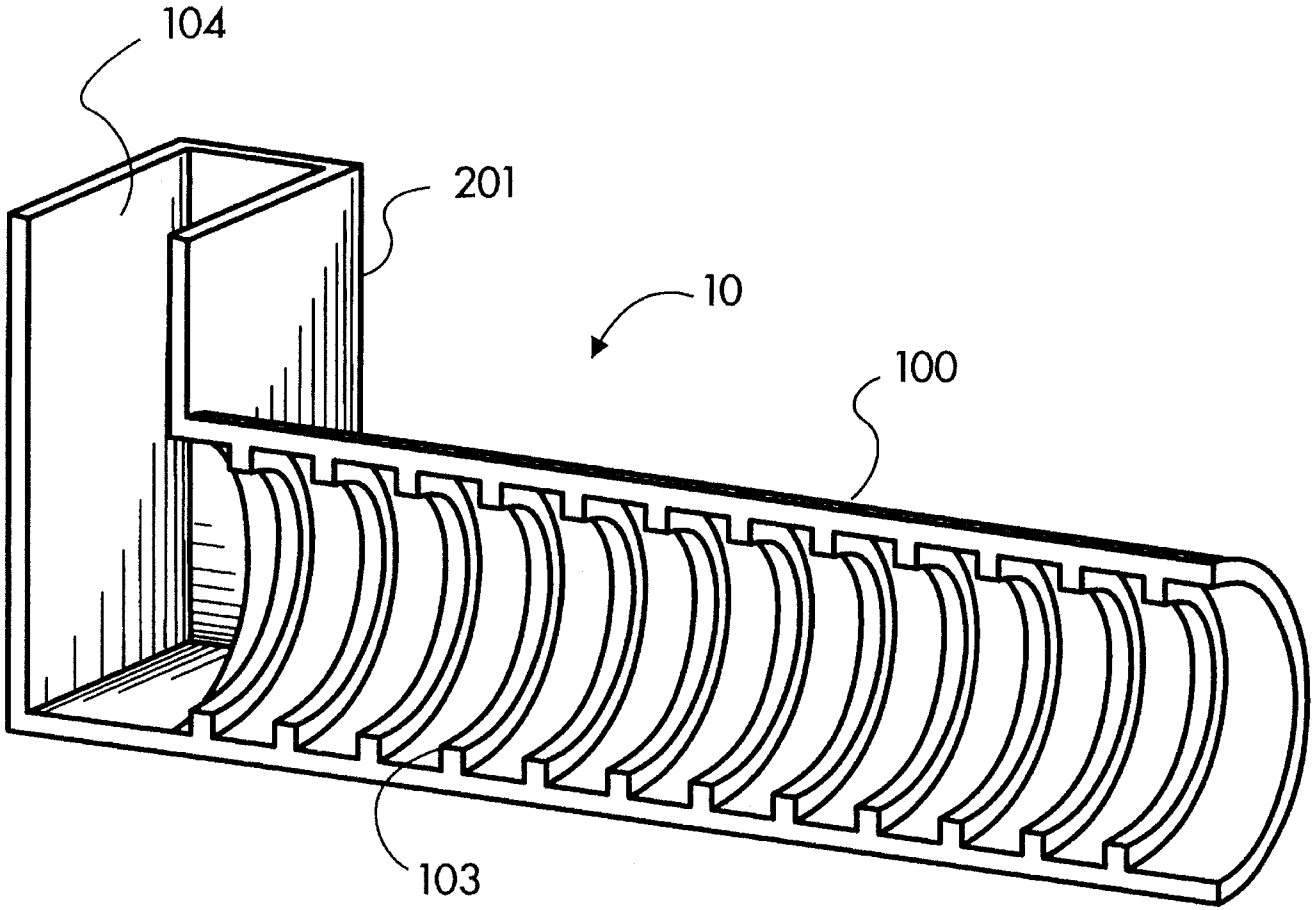
FIG. 4 is a perspective view of the embodiment of FIG. 2 showing the ribs more clearly.

FIG. 4 provides a perspective view of the developer 10. To more clearly show the ribs 103, the developer sleeve 101 and magnetic element 102 are not shown.

Figure 3:
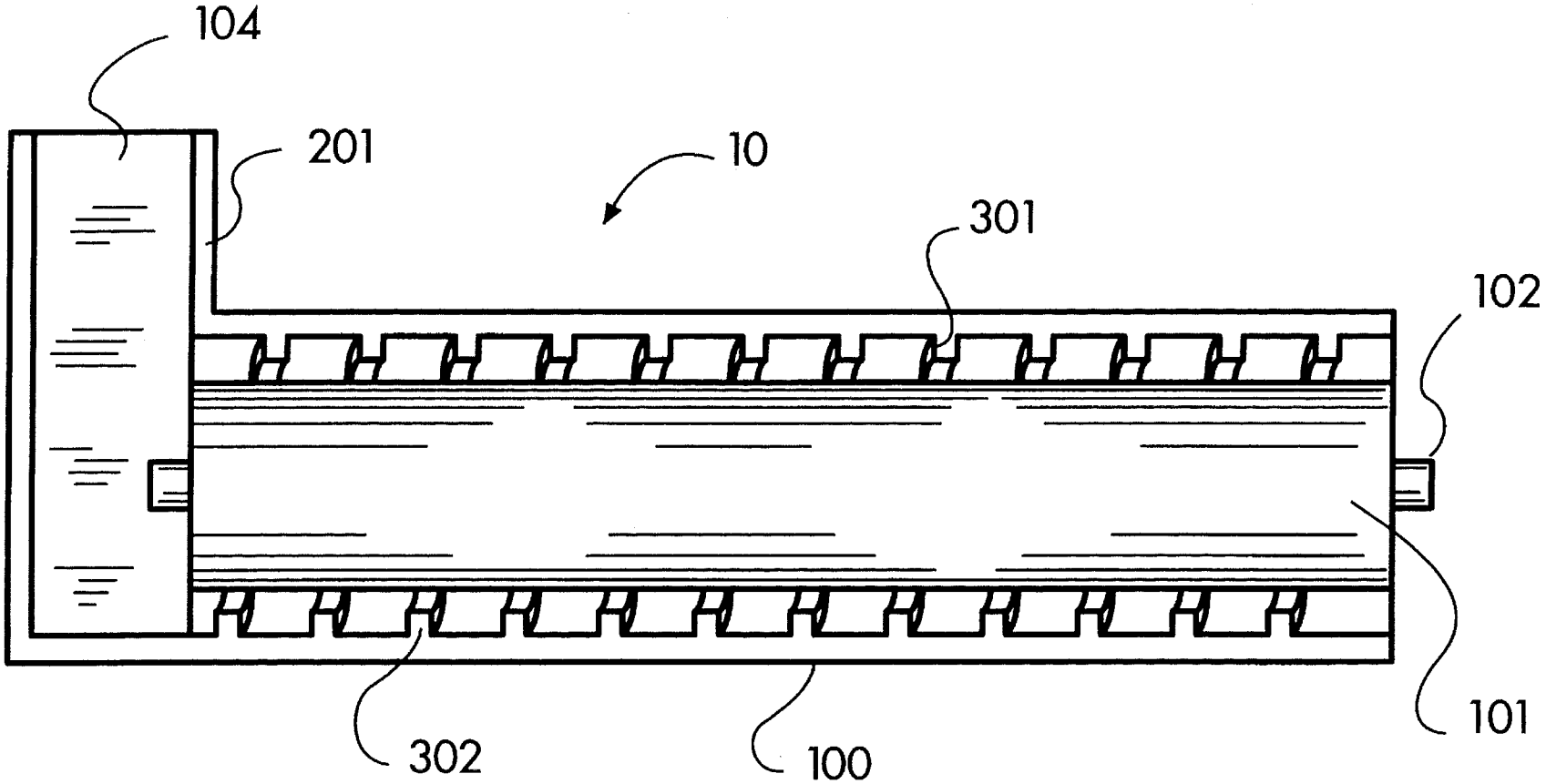
FIG. 3 depicts an alternative embodiment in accordance with the present invention.

Referring next to FIG. 3 where an alternative embodiment of the present invention is shown. Here, ribs 301 and 302 are arranged such that a driving motion of toner 104 is created in both directions along developer sleeve 101. Toner is forced down the length of the developer 10 such that when it reaches a certain height, ribs 301 induce a force in the opposite direction thereby driving excess toner 104 back towards toner hopper 201. Such an arrangement increases mixing of toner 104 and also ensures that the developer sleeve 101 has a continuous fresh supply of toner.

Figure 5:
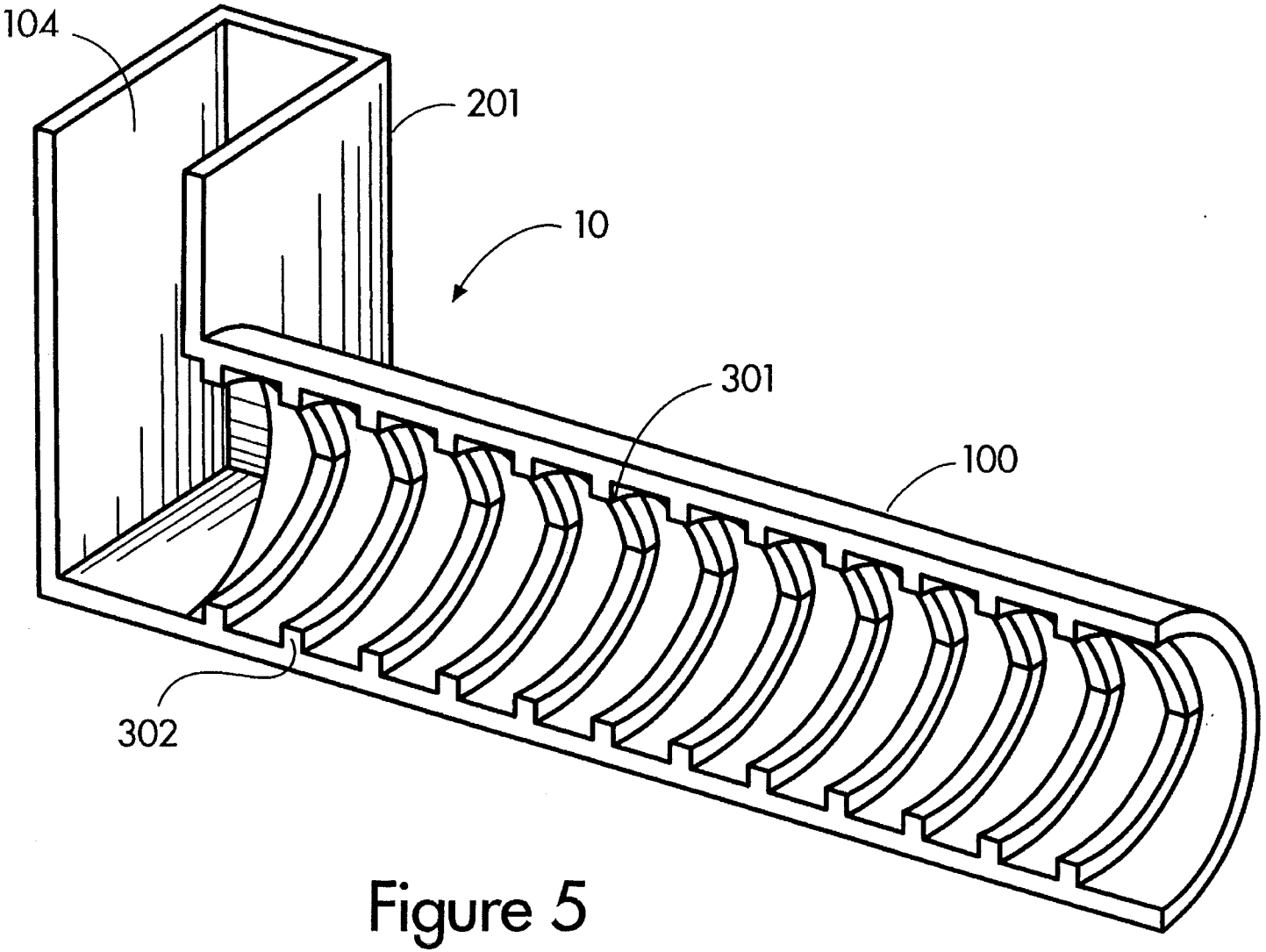
FIG. 5 is a perspective view of the embodiment of FIG. 3 showing the ribs more clearly.

FIG. 5 provides a perspective view of the developer 10. To more clearly show the ribs 301 and 302, the developer sleeve 101 and magnetic element 102 are not shown.

These ribs can easily be formed in the developer housing 100 especially when that housing is formed by injection molding. Thus, with the present embodiment, it is possible to move developer material down the length of developer 10 without requiring additional moving parts. Such an arrangement reduces cost to the developer while maintaining a high standard of reliability.

While the above detailed description has focused on an arrangement wherein the magnetic element is held stationary and the developer sleeve rotates, it will be readily apparent to one skilled in the art that the present invention also works where the developer sleeve is stationary and the magnetic element rotates.

Although the preferred embodiment of the invention has been illustrated and that form described it is readily apparent to those skilled in the art that various modifications may be made therein without departing from the spirit of the invention or from the scope of the appended claims.

What is claimed is:

1. An arrangement for moving a material along an axis, said arrangement comprising of:

a. a housing having a cavity, said cavity extending along said axis;

b. a plurality of angled members formed inside said cavity; and c. a rotation means mounted inside said housing, said rotation means induces said material to rotate about said axis, said material being in contact with said plurality of angled members, wherein said rotation of said material is translated into a lateral motion of said material along said axis by said plurality of angled members.

2. An arrangement as claimed in claim 1, said rotation means comprising:

a rotating member, said rotating member being rotated about said axis; and an attraction means for attracting said material towards said rotating member.

3. An arrangement as claimed in claim 1 wherein said material has magnetic properties.

4. An arrangement as claimed in claim 3, said rotation means comprising:

a hollow sleeve formed from magnetically transparent material, said hollow sleeve further being rotated about said axis; and a magnetic element placed inside said hollow sleeve.

5. An arrangement as claimed in claim 3, said rotation means comprising:

a magnetic element being rotated about said axis.

6. A developer used in an output means, said developer comprising of:

a developer housing;

a developer material inside said developer housing, said developer material having magnetic properties; a developer material supply located on a first side of said developer housing;

a developer sleeve, said developer sleeve being hollow and formed from magnetically transparent material, said developer sleeve being placed inside said developer housing, said developer sleeve further being rotated about an axis;

a magnetic element placed inside said developer sleeve, said magnetic element magnetically attracts said developer material toward said developer sleeve such that said rotation of said developer sleeve induces a rotational motion about said axis in said developer material; and said developer housing having angled ribs formed inside, said angled ribs arranged wherein said rotational motion of said developer material is translated into a lateral motion of said developer material in a direction away from said first side of said developer housing.

7. A developer as claimed in claim 6 wherein said magnetic element is a permanent magnet.

8. A developer used in an output means, said developer comprising of:

a developer housing;

a developer material inside said developer housing, said developer material having magnetic properties;

a developer material supply located on a first side of said developer;

a developer sleeve, said developer sleeve being hollow and formed from magnetically transparent material, said developer sleeve being placed inside said developer housing;

a magnetic element placed inside said developer sleeve, said magnetic element further being rotated about an axis, said magnetic element magnetically attracts said developer material toward said developer sleeve, said rotation of said magnetic element induces a rotational motion about said axis in said developer material; and said developer housing having angled ribs formed inside, said angled ribs arranged wherein said rotational motion of said developer material is translated into a lateral motion of said developer material in a direction away from said first side of said developer housing.

9. A developer as claimed in claim 8 wherein said magnetic element is a permanent magnet.

* * * * *